United States Patent [19]

Hayes

[11] Patent Number: 4,796,681

[45] Date of Patent: Jan. 10, 1989

[54] CONTINUOUSLY MOVING LATHE KNIFE

[76] Inventor: Leonard L. Hayes, P.O. Box 230215, Tigard, Oreg. 97223

[21] Appl. No.: 140,732

[22] Filed: Jan. 4, 1988

[51] Int. Cl.[4] ..... B27L 1/00

[52] U.S. Cl. ..... 144/212; 83/794; 83/801; 83/820; 144/209 R; 144/365

[58] Field of Search ..... 83/794, 801, 820; 144/209 R, 212, 213, 365, 241, 218

[56] References Cited

U.S. PATENT DOCUMENTS

| | | | |
|---|---|---|---|
| 884,544 | 4/1908 | Usina . | |
| 1,940,105 | 12/1933 | Schmid . | |
| 2,173,336 | 9/1939 | Lamere et al. . | |
| 3,381,727 | 5/1968 | Hayes . | |
| 3,633,450 | 1/1972 | Grote . | |
| 4,640,170 | 2/1987 | Bakken | 83/794 |

FOREIGN PATENT DOCUMENTS

| | | | |
|---|---|---|---|
| 969320 | 12/1950 | France | 144/212 |
| 44260 | 7/1918 | Sweden | 83/794 |

*Primary Examiner*—W. Donald Bray
*Attorney, Agent, or Firm*—Zarley McKee, Thomte, Voorhees & Sease

[57] ABSTRACT

A continuously moving lathe knife is provided which can be retrofit to an existing lathe carriage. The knife assembly includes a chain bar secured to the knife carriage with a pair of sprockets at either end of the chain bar. An endless loop chain extends around the sprockets. A power source rotates one of the sprockets so as to rotate the chain around the sprockets. The movement of the chain is guided by a channel in the chain bar. Each link of the chain includes a knife tip for cutting a layer of veneer from a wooden log which is rotated about its longitudinal axis as the chain is rotated in a plane parallel to the log surface.

11 Claims, 3 Drawing Sheets

CONTINUOUSLY MOVING LATHE KNIFE

BACKGROUND OF THE INVENTION

Conventional lathe knives used in cutting sheets of wood veneer from a log utilize an oscillating blade to cut the veneer, such as that described in applicant's previous Pat. No. 3,381,727 issued May 7, 1968. Other lathes use a fixed blade which is forced through the wood to cut the veneer. These prior art lathes have problems associated with the limited movement of the knife or blade, including the high frictional forces, which are developed between the blade and the log, which requires greater power to turn the log and limits the speed of the cutting operation. Furthermore, those lathes produce wood splitting, grain rolling, roughness, and low quality due to the oscillating or fixed blade.

Therefore, a primary objective of the present invention is to provide a lathe knife which continuously moves transversely to the log so as to produce a high quality sheet of veneer.

Another objective of the present invention is the provision of a continuously moving lathe knife which can be retro-fit upon existing lathe carriages.

Another objective of the present invention is the provision of a continuously moving lathe knife which produces a shearing or slicing action so as to produce a clean cut for the veneer.

Still a further objective of the present invention is the provision of a lathe knife which moves continuously transverse to the log so as to cut through knots and fibers.

Yet another objective of the present invention is the provision of a continuously moving lathe knife which is self cleaning.

A further object of the present invention is the provision of a continuously moving lathe knife which has replaceable knife tips.

Another objective of the present invention is the provision of a continuously moving lathe knife which is economical to manufacture, and durable and safe in use.

These and other objectives will become apparent from the following description of the invention.

SUMMARY OF THE INVENTION

A lathe machine is provided for cutting sheets or layers of veneer from a wooden log. The machine includes a frame with chucks for rotatably supporting and rotating an elongated wooden log on its center axis. A knife carriage is movably mounted on the frame and is moved towards and away from the log by hydraulics.

A chain saw type assembly is fixed on the frame for cutting the veneer from the log. The chain saw assembly includes a chain bar secured to the knife carriage and having a channel extending around the chain bar. An endless-loop chain formed from a plurality of pivotably connected chain links movably extends through the chain bar channel. The chain includes an outer guide link, a middle stabilizer link, and an inner guide link, which are pinned together. The stabilizer link is offset with respect to the guide links so that the chain links are pivotal with respect to one another. The guide links are tracked in the chain bar channel and the stabilizer link is received in a deeper annular groove which is in communication with the channel. The chain is driven by sprockets located at each end of the chain bar. Each outer guide link has a knife tip for cutting the veneer from the wood as the chain rotates around the sprocket and chain bar. In one embodiment the knife tips are replaceable.

DETAILED DESCRIPTION OF THE DRAWINGS

Figure 1:
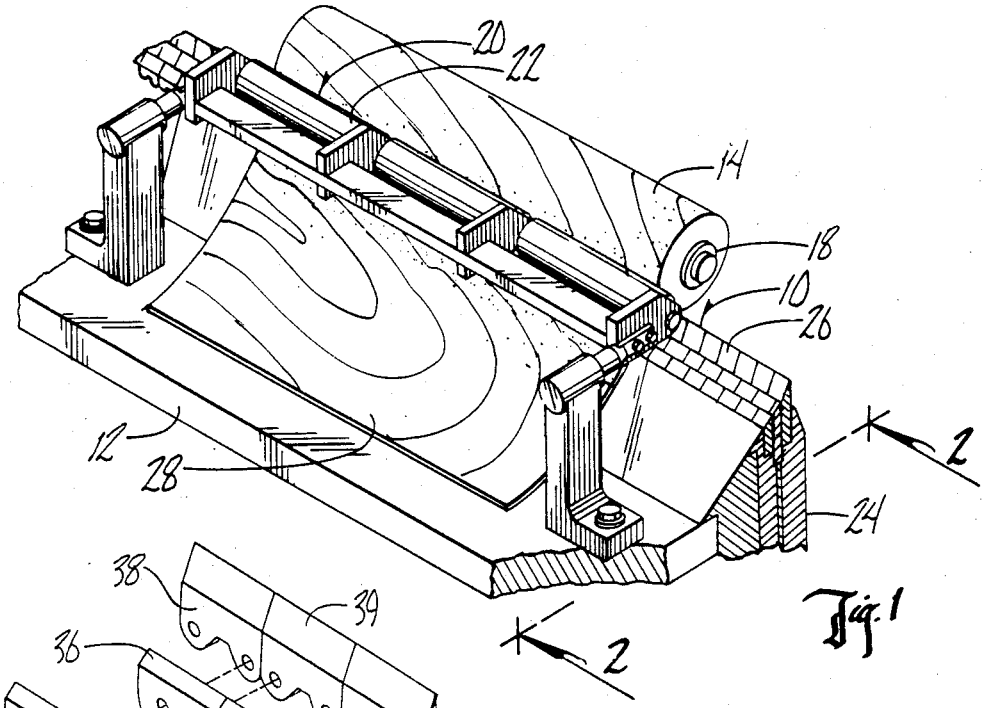
FIG. 1 is a partial sectional perspective view of the continuously moving lathe knife of the present invention.
Figure 3:
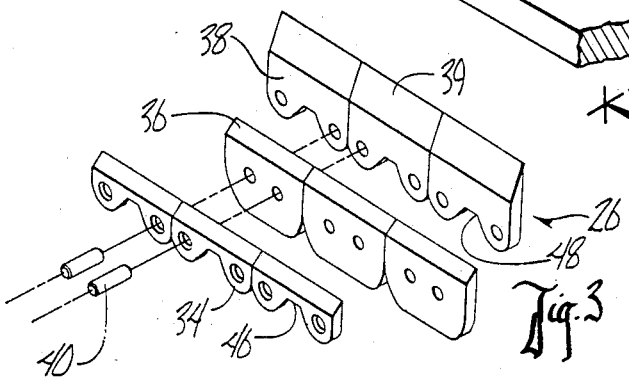
FIG. 3 is an exploded view of the chain links of the lathe knife.

The continuously moving lathe knife of the present invention is generally designated by the reference numeral 10 in the drawings. This knife is adapted to be retro-fit on an existing lathe carriage 12 which is adapted to be moved towards and away from a wooden log 14 by hydraulic system 16. A log 14 is rotatably mounted on chucks 18 so as to be rotatable about its longitudinal center axis. Lathe carriage 12 also includes an adjustable depth gauge 20 having a roller 22 thereon for applying constant pressure on the log and thereby maintaining a constant thickness of the veneer being cut by the knife.

Figure 2:
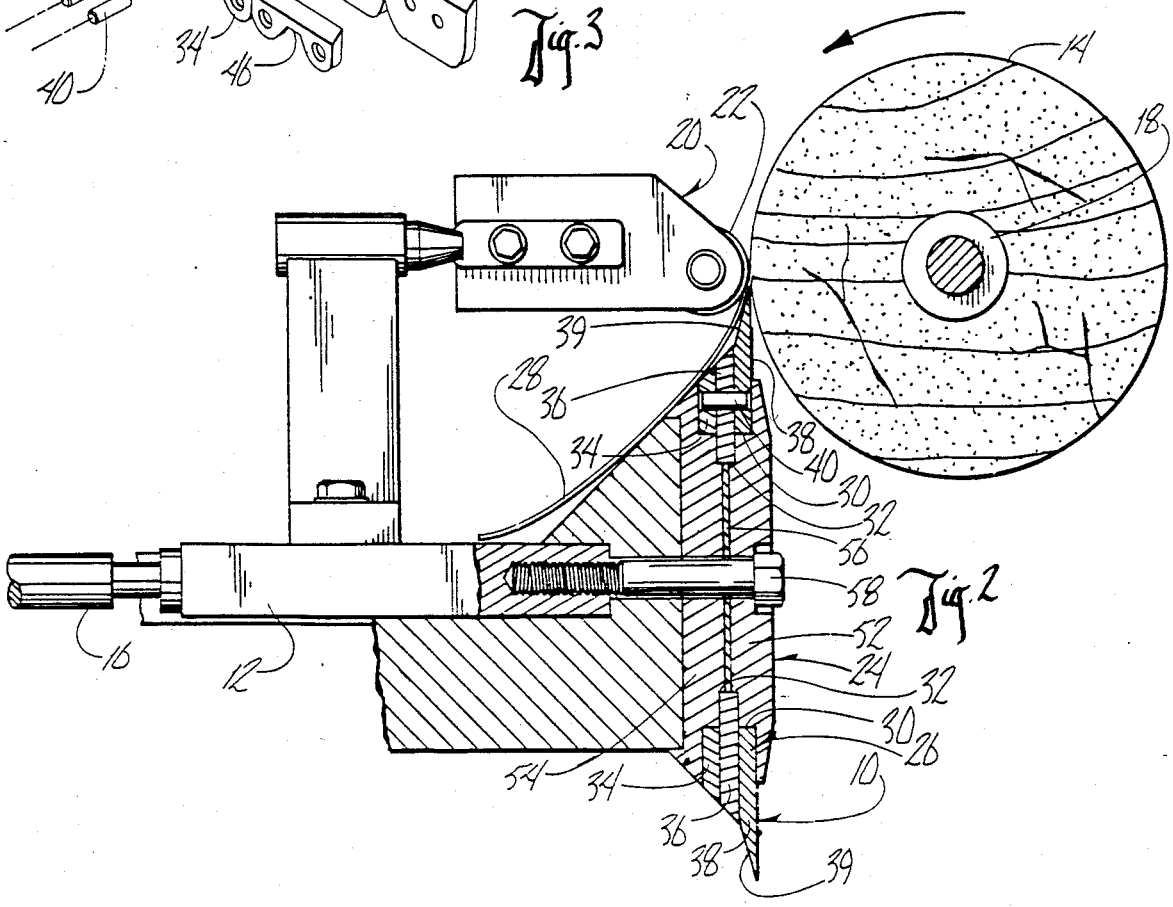
FIG. 2 is a sectional view taken along lines 2—2 of FIG. 1.
Figure 4:
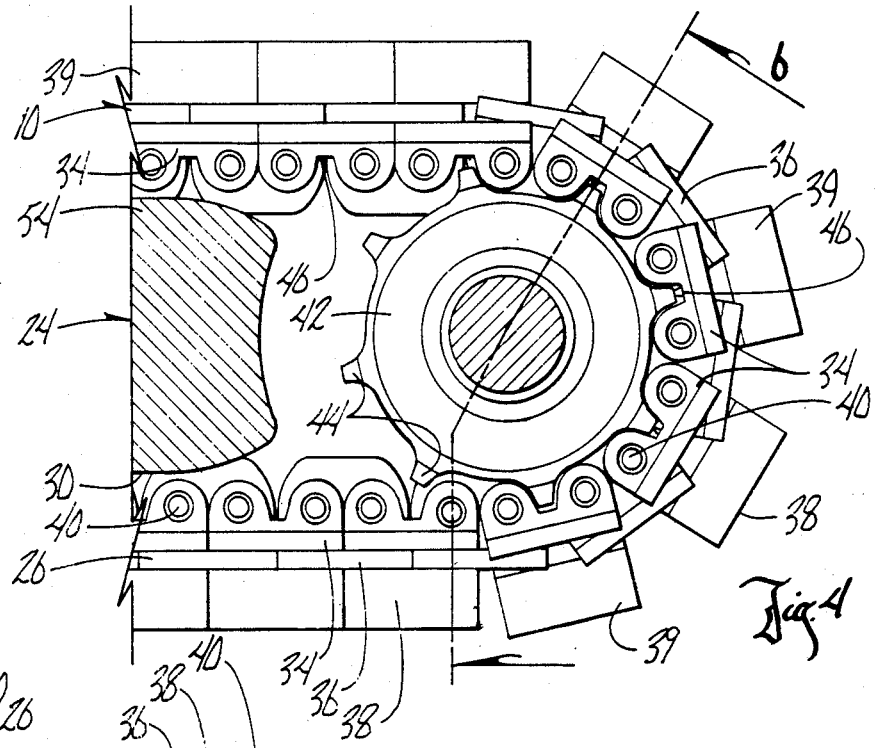
FIG. 4 is a partial elevational view of one end of the lathe knife assembly.
Figure 5:
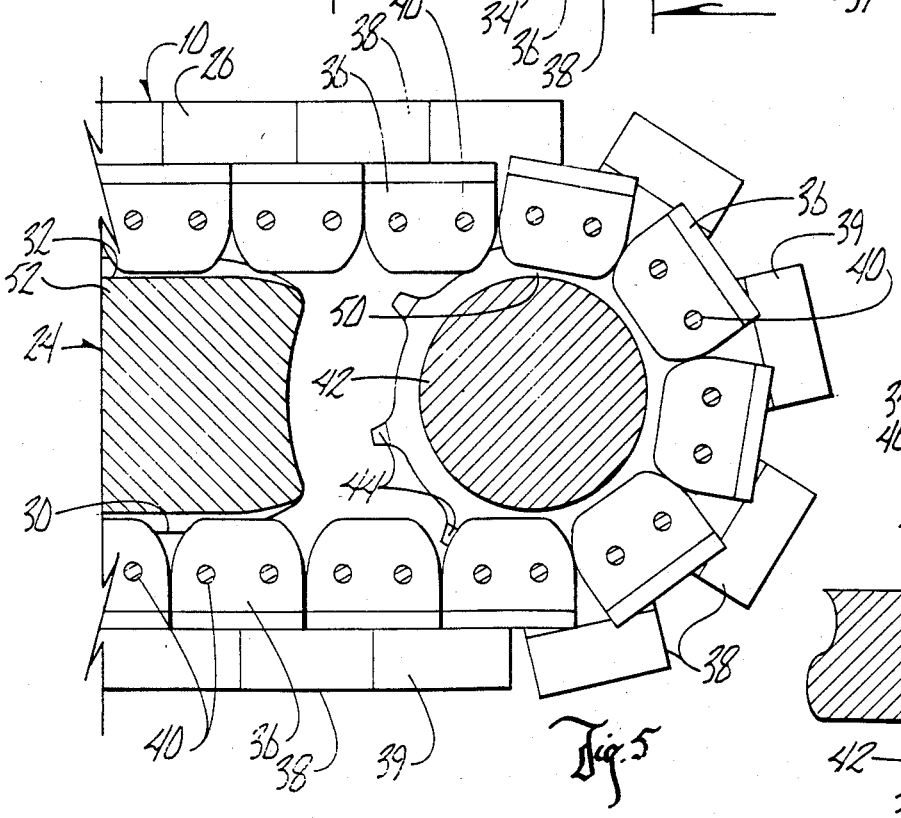
FIG. 5 is a view similar to FIG. 4 wherein the inner guide links have been removed for clarity.
Figure 6:
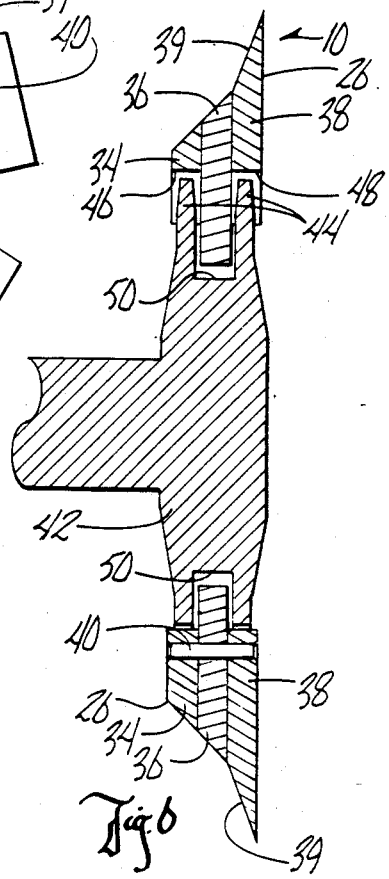
FIG. 6 is a sectional view taken along lines 6—6 of FIG. 4.

Lathe knife 10 includes a chain bar 24 with an endless loop chain 26 which rotates around the chain bar so as to cut a layer of veneer 28 from the wood log 14. More particularly, chain bar 24 includes a channel 30 with a deeper annular groove 32 in communication therewith. Chain 26 is formed from a plurality of pivotably connected links, including an inner guide link 34, and an intermediate stabilizer link 36 and an outer guide link 38. Each link has a pair of holes therein for receiving a connecting pin 40. The stabilizer links 36 are offset with respect to the guide links 34, 38 so that the guide links are pivotal with respect to the stabilizer link. Each outer guide line 38 has a sharp knife tip 39 for cutting the veneer layer from the log. The upper edges of links 34, 36, and 38 are beveled, as seen in FIG. 2, to provide a receiving or slide surface for the veneer. A honing device (not shown) can be provided on lathe knife 10 to keep knife tips 39 sharp.

Channel 30 provides a guide track for guide links 34, 38 while annular groove 32 provides a guide track for stabilizing link 36. A drive sprocket 42 and an idler sprocket (not shown) are positioned at opposite ends of chain bar 24. Both sprockets include pairs of spaced-apart teeth 44 extending around the perimeter of the sprocket. These teeth 44 are adapted to be received in recesses 46, 48 in guide links 34, 38, respectively. The space between teeth 44 defines a groove 50 in which stabilizer link 36 is received. Accordingly, chain 26 is trained around chain bar 24, with the stabilizer links 36 received in the annular groove 32 and groove 50 in the sprockets. Guide links 34 and 38 are guided by the walls of channel 30 and teeth 44 on the sprockets. Actuation of a power source rotates drive sprocket 42 which causes chain 26 to rotate about the drive sprocket and the idler sprocket as guided by the chain bar 24.

Chain bar 24 is comprised of first and second elongated plates 52 and 54, with a shim member 56 positioned therebetween, are best seen in FIG. 2. A bolt or other fastening means 58 secures the plates 52, 54 to the lathe carriage 12. Shim 56 can be replaced with other shims having various thicknesses such that the width of channel 30 and annular groove 32 can be adjusted. Accordingly, the tracking tension on chain 26 can be varied as necessary. Also, the friction from the operation of the lathe knife 10 will eventually require the width of channel 30 and annular groove 32 to be decreased to account for wear on chain bar 24 and chain 26. Furthermore, chains having different width can be accommodated, for example heavy-duty and lightweight chains.

In operation, drive sprocket 42 is rotated by a power source (not shown) so as to impart rotation to chain 26. The chain thus revolves around the sprockets and within the guide bar channel such that the knife tips 39 move parallel with the longitudinal axis of log 14 and cut a layer of veneer therefrom as the log is rotated about its axis by chucks 18. As the veneer is cut, hydraulic system 16 advances carriage 12 towards the axis of log 14 to account for the decreasing diameter of the log. Depth gauge 20 maintains a constant pressure on the surface of the log so that the veneer thickness remains constant. The spacing between the surface of roller 22 and knife tips 39 can be adjusted so that the thickness of the veneer can be adjusted.

The rotating speed of chain 26 and/or log 14 can be adjusted to control the smoothness of the veneer. As the chain speed increases, the veneer smoothness improves. As the log speed increases, the veneer smoothness decreases. Thus, the desired quality of the veneer surface can be controlled by varying the chain and/or log rotational speed.

Figure 7:
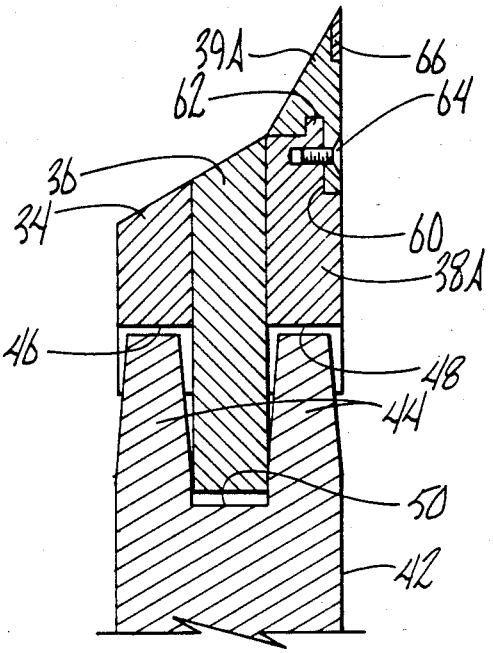
FIG. 7 is a sectional view of an alternative embodiment of a chain assembly having replaceable knife tips.
Figure 8:
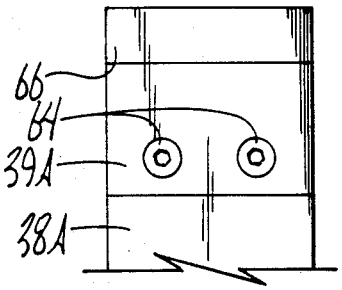
FIG. 8 is a front elevational view of a replaceable knife tip.

FIGS. 7 and 8 show an alternative embodiment wherein knife tips 39A are replaceable. More particularly, each outer guide link 38A has a recessed forward wall 60 and an upper projection 62. The knife tip 39A matingly engages link 38A, as seen in FIG. 7 and is secured to link 38A by screws 64. Knife tips 39A have a carbide tip 66 for cutting the veneer. When tip 66 gets dull or damaged, screws 64 can be removed so that knife tip 39A can be replaced.

It is understood that the chain saw type cutting assembly of the present invention can also be employed in a slicer machine wherein a sheet of veneer is cut from the planar surface of a non-rotating block of wood. By moving the carriage assembly across the block surface as the chain rotates, a layer of veneer is cut from the block of wood. Alternatively, the block of wood can be moved in a planar direction through the chain as the chain rotates to cut a layer of veneer from the wood block.

While the term "wood veneer" is used in the description and in the appended claims, it is understood that materials other than wood can be veneered, without departing from the spirit or scope of this invention. Further, it should be understood that the devices of this invention will create veneer even if the log is rotated against a fixed chain, with the chain being moved only when the fixed edge portion becomes dull.

Accordingly, a lathe knife is provided which provides a clean cut, unblemished veneer. Thus, at least all of the stated objectives are accomplished by the lathe knife of the present invention.

What is claimed is:

1. A knife assembly for cutting layers of veneer from the surface of a log, comprising:

a frame;

a knife carriage on such frame;

a chain bar on such knife carriage;

a chain channel with an angular groove extending substantially around said chain bar;

a continuous chain comprising a plurality of pivotally connected chain links movably extending through said channel and a stabilizing link secured to each of said pivotally connected links, said stabilizer links being slidably mounted in said annular groove, each chain link including a knife tip;

means for moving the surface of the log and the carriage relative to one another; and means on said frame for rotating said chain around said chain bar and within said channel such that said knife tips cut a layer of veneer from said log.

2. The machine of claim 1 wherein the distance from the inner to the outer ends of said stabilizing link is approximately four inches.

3. The machine of claim 1 wherein said chain further includes an outer guide link and an inner guide link on opposite sides of said stabilizer link, and pin means for securing said links together, said stabilizer link being longitudinally offset with respect to said guide links such that said pin means pivotally connect each stabilizer link to adjacent outer guide links and to adjacent inner guide links.

4. The machine of claim 3 wherein said chain bar includes an annular groove in communication with said channel, said guide links being slidably received in said channel and said stabilizer links being slidably received in said annular groove.

5. The machine of claim 3 wherein said knife tips are on said inner guide links.

6. The machine of claim 3 wherein said means for rotating said chain includes a drive sprocket and an idler rotatably mounted at opposite ends of said chain bar, and drive means for rotating said drive sprocket, said chain being trained around said sprockets.

7. The machine of claim 6 wherein said sprockets include pairs of spaced apart teeth extending around the perimeter of said sprockets for matingly engaging recesses in said inner and outer guide links and said stabilizer links being received in the space between said pairs of teeth.

8. The machine of claim 4 wherein each of said links includes a beveled upper edge to provide a slide surface for the veneer.

9. The machine of claim 1 wherein said chain bar includes a pair of chain bar plates with shim means therebetween and means for securing said plates and shim means to said knife carriage, said shim means permitting for adjustment of the width of said chain channel.

10. The machine of claim 1 further comprising an adjustable depth gauge for controlling the depth of cut into said log and thereby the thickness of said veneer.

11. The machine of claim 1 wherein the knife tips are replaceably secured to each chain link.

* * * * *